US008152932B2

(12) United States Patent
Hempel

(10) Patent No.: US 8,152,932 B2
(45) Date of Patent: Apr. 10, 2012

(54) METHOD FOR REMOVING SCUM IN A DRUM WASHING MACHINE, AND DRUM WASHING MACHINE SUITABLE FOR THIS PURPOSE

(75) Inventor: Meike Hempel, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 509 days.

(21) Appl. No.: 12/308,345

(22) PCT Filed: May 22, 2007

(86) PCT No.: PCT/EP2007/054913

§ 371 (c)(1),
(2), (4) Date: Dec. 12, 2008

(87) PCT Pub. No.: WO2007/144248

PCT Pub. Date: Dec. 21, 2007

(65) Prior Publication Data

US 2010/0154829 A1 Jun. 24, 2010

(30) Foreign Application Priority Data

Jun. 12, 2006 (DE) ..... 10 2006 027 197

(51) Int. Cl.
*D06F 33/02* (2006.01)

(52) U.S. Cl. ..... 134/33; 68/12.05; 68/12.12

(58) Field of Classification Search ..... 68/12.05, 68/12.21; 134/33

See application file for complete search history.

(56) References Cited

U.S. PATENT DOCUMENTS 5,890,247 A * 4/1999 Erickson et al. ..... 8/158
2005/0197264 A1 9/2005 Czyzewski et al.
2006/0168740 A1 * 8/2006 Ha et al. ..... 8/158

FOREIGN PATENT DOCUMENTS

EP 1 213 384 6/2002
EP 1 719 832 11/2006

OTHER PUBLICATIONS

International Search Report PCT/EP2007/054913.

* cited by examiner

*Primary Examiner* — Michael Barr
*Assistant Examiner* — Caitlin N Dennis
(74) *Attorney, Agent, or Firm* — James E. Howard; Andre Pallapies

(57) ABSTRACT

A method for removing scum in a tub of an electronically controlled drum washing machine. The method includes alternately rotating a drum following a main washing cycle and pumping liquid out of the drum, pumping a liquid out of the drum for between 30 seconds to 15 minutes following a main washing cycle and pumping liquid out of the drum, regulating a level of water following a main washing cycle and pumping liquid out of the drum by: introducing a quantity of water into the drum which is sufficient to cover all water channels, and rinsing over a short period of time $t_2$. The method further including pumping liquid out of the drum while the drum is moved at a low rotational speed following a main washing cycle and pumping liquid out of the drum.

16 Claims, 3 Drawing Sheets

Water inlet
Temperature
Pressure
Rotational speed
Step a)
Steps b) to d)
Time

METHOD FOR REMOVING SCUM IN A DRUM WASHING MACHINE, AND DRUM WASHING MACHINE SUITABLE FOR THIS PURPOSE

BACKGROUND OF THE INVENTION

The invention relates to a method for removing scum in a drum washing machine and a drum washing machine suitable for this purpose. In particular, the invention relates to a method for removing scum in a tub of an electronically controlled drum washing machine, wherein, following a main washing cycle and an operation for pumping out the liquid, certain steps are carried out, and also a drum washing machine suitable for this purpose.

In a conventional drum washing machine, high-speed spinning takes place immediately after the main wash cycle and the rinse cycles. If an excessive amount of scum is present or is produced during spinning, the detergent-solution pump does not however pump the scum/detergent-solution mixture or at all events pumps it poorly. The spinning is therefore not performed when scum is detected during pumping out or in the event of scum being detected during the spinning operation. Early detection of scum is thus important in order to enable efficient measures to be taken to remove the scum.

According to DE 41 04 151 A1, the scum is destroyed by switching on a heating facility. In order to also destroy the scum in the extended surrounding area of the heating facility, the drum is rotated slowly such that further scum reaches the heating facility where it is destroyed by the application of heat.

A facility for destroying detergent scum is described in DE 43 34 969 A1, which has a device for generating hot air that is introduced between the tub and the drum by means of a feed pipe in the tub wall.

In addition, methods for removing scum in a tub of a drum washing machine are known from DE 102 34 472 A1 and also from DE 198 46 248 A1.

DE 102 34 472 A1 thus describes a method for removing scum in a tub of an electronically controlled drum washing machine as a result of a program step which is provided for draining the tub, having a detergent-solution runoff system arranged on the base of the tub which has a detergent-solution pump and a sensor for determining the level of liquid contained in the tub. The waveform of the sensor signal (P) which is recorded during operation of the detergent-solution pump contains a gradient $\Delta p_n/\Delta t_n$, in comparison with $\Delta p_{n-1}/\Delta t_{n-1}$, which indicates the presence of scum, whereupon a scum handling measure matched to the gradient is then initiated.

As described in EP 0 278 239 A1, excessive scum formation in the main washing cycle, which can be observed while the washing detergent solution is being heated in the tub, is removed by the addition of a limited quantity of cold water and/or by temporarily switching off the detergent solution heating.

SUMMARY OF THE INVENTION

The object of the invention was therefore to provide a method to enable the scum occurring in a washing machine to be more effectively combated than when using conventional methods. The object of the invention was also to present a drum washing machine suitable for execution of this method.

According to the invention, these objects are achieved by a method and by a drum washing machine having the features of the exemplary embodiments described herein.

The present invention thus relates to a method for removing scum in a tub of an electronically controlled drum washing machine having a detergent-solution runoff system arranged on the base of the tub which has a detergent-solution pump and a sensor for determining the level of a liquid contained in the tub, the signal from this sensor being recorded during operation of the detergent-solution pump, and a drum, whereby the following steps are carried out following a main washing cycle and an operation for pumping out the liquid:

a) Alternate rotation of the drum at a low rotational speed $U_1$ and standstill of the drum and also pumping out the liquid over a period of time $t_1$ from 30 seconds to 15 minutes, preferably 2 to 10 minutes, by particular preference 2.5 to 4 minutes, b) Letting in a quantity of water which is sufficient to cover all water channels, and rinsing over a short period of time $t_2$, whereby the level is regulated by way of a very small hysteresis, c) Pumping out the liquid while the drum is moved at a low rotational speed $U_2$.

The invention also relates to a drum washing machine having a program control unit for controlling the program execution, a drum rotatably mounted in a tub, a detergent-solution runoff system arranged on the base of the tub which has a detergent-solution pump, a drive motor for the drum, a heating facility, a sensor for determining the level of liquid contained in the tub and switching equipment for rotating and stopping the drum, whereby the switching equipment is able to execute the method described above in the event of scum being detected.

In step a), the rotational speed $U_1$ preferably ranges from 20 to 60, and by particular preference lies between 30 and 50 revolutions per minute.

In step a), the duty cycle (abbreviated to "ED" in the following) is preferably 2 to 30%, by particular preference 5 to 15%. The duty cycle ED here is a measure of the proportion of the time the drum is rotating related to the overall time during which the drum is in rotation and at a standstill. The duty cycle is normally given as a percentage, whereby 50% means that over a particular period the drum is moving half the time and is stationary half the time, for example it is moving for 30 seconds and stationary for 30 seconds.

In step a), the drum is preferably rotated at a frequency of 1 to 5, by particular preference 2 to 4 rotation operations per minute.

By preference, the pump is switched off when the drum is at a standstill. Rotation of the drum preferably takes place in both directions, reverse action in other words.

If in step b) a quantity of water is let in which is sufficient to cover all water channels, then this means that the water inlet takes place up to a safe, high level above all water channels.

Water channels are understood to be those channels by which water enters the tub. This can take place exclusively by way of a dispenser tray, by means of which detergent is also flushed into the tub, and/or directly into the tub.

In this manner, the residual scum is flushed with a substantial quantity of water from the water channels and diluted. Water having a temperature which lies beneath the temperature of the washing detergent solution in the tub during the main washing cycles is preferably used for this purpose because the washing detergent solution is cooled by this means. The water channels are flushed clear, which prevents plugs of scum lodged there from being forced into the dispenser tray—and possibly out of the washing machine— during a subsequent rinsing operation. The cooling of the washing detergent solution additionally prevents the scum from stabilizing.

In step b), the terms "letting in water" and "rinsing" have a close and inseparable relationship which arises from the description given in step b).

According to the invention, a level regulation is performed by way of a very small hysteresis in step b). "Hysteresis" in the context of the invention is the pressure difference between the pressure at the upper switching point for the water supply and the pressure at the lower switching point for the water supply. According to the invention, this pressure difference (hysteresis) preferably lies in the range from 10 to 150 Pa, by further preference from 20 to 100 Pa and by particular preference in the range from 30 to 70 Pa. With a very small hysteresis according to the invention, it has surprisingly been found that an effective scum dilution results without renewed foaming (scum formation). It has been found that the dissolution of the scum in the water causes a reduction in the pressure; the small hysteresis supports frequent subsequent drawing-in of water, with the result that the greatest possible quantity of water is always present for diluting the detergent concentration in the washing machine.

The period of time $t_2$ preferably ranges from 1 to 5 minutes, by particular preference from 1 to 3 minutes.

Pumping out of the liquid in step c) takes place while the drum is being moved at a low rotational speed $U_2$. The values for the rotational speed $U_2$ preferably lie in the preferred range specified for the rotational speed $U_1$, whereby the rotational speeds $U_1$ and $U_2$ can be selected independent of one another.

The gentle movement of the drum in step c) prevents the scum from settling like a blanket on the washing. Instead, the scum is rolled around and transported away more efficiently.

By preference, spinning (step d) takes place over a short period of time $t_3$ between step a) and step b) at a rotational speed $U_3$ of the drum below 500 revolutions/minute, preferably at a rotational speed below 400 revolutions/minute, by particular preference at a rotational speed in the range of 100 to 200 revolutions per minute. The period of time $t_3$ preferably lies in the range from 30 seconds to 5 minutes, by particular preference from 1 to 2 minutes.

It has surprisingly been found that the scum is not newly foamed up or forced out of the tub during this spinning. Instead, the destabilized scum is broken up and restructured or compacted.

In a particularly preferred embodiment of the method, following on from step d), in other words between steps d) and c), (e) the drum is alternately rotated at a low rotational speed $U_5$ and the drum is then at a standstill and the liquid is also pumped out during a period of time $t_4$ of between 30 seconds and 15 minutes, preferably between 2 and 10 minutes, by particular preference between 2.5 and 4 minutes (step e)).

In step e), the values for the rotational speed $U_5$ preferably lie in the preferred range specified for the rotational speed $U_1$, whereby the rotational speeds $U_1$ and $U_5$ can be selected independent of one another.

With regard to the method, preferably following on from step c) a normal spin and rinse is performed (spinning prior to a rinse cycle), in which scum can be detected again. By preference in this situation, the spinning is aborted when scum is detected and the method according to the invention is executed with steps a) to c) and also where applicable steps d) and e).

It has surprisingly been found that use of the method according to the invention results in the scum efficiently "dripping down". The water trickles along the walls of the membranes of the small bubbles downwards and runs off through the holes present in the drum. It is assumed that the scum becomes unstable on account of the bubble walls becoming ever thinner. The scum is thus broken up as a result of the motion of the drum. The burst small bubbles then release further liquid which can flow down in the idle phase following the motion phase of the drum.

With regard to the method according to the invention, the drum is alternately rotating and at a standstill in step a) and where applicable in step e). In this situation, pumping out of the liquid preferably takes place at intervals, whereby the water can accumulate between the pumping steps. The pump can be switched on while the drum is in its motion and standstill phases. By preference, however, the pump is switched off between the pumping steps.

By preference, before the method according to the invention is executed a check is carried out for the presence of scum ("scum detection"). Which type of sensors are used for the purpose of scum detection is unimportant for the measures to be executed in the event of a signal indicating scum ("scum signal").

In general, scum detection is applied during pumping out of the washing detergent solution and also during rinsing. By preference, one of the following measures is taken in this situation:

scum detection during pumping out when drum is at a standstill by means of evaluation of the gradient in the pressure curve in the case of a sensor (for example a transducer housing which generally contains an air hose in which the quantity of water present can be determined through the compression of air).

scum detection by means of a pressure level detected in the transducer housing during spinning The scum detection can however also take place by way of a conductance measurement using two electrodes in the lower region of the tub.

Furthermore, scum detection during spinning is possible by means of an evaluation of the difference between nominal and actual rotational speed. With regard to scum detection by means of an evaluation of the difference between nominal and actual rotational speed use is made of the circumstance that the scum can decelerate a rotating drum, as a result of which a difference results between the nominal and the actual rotational speed. In this situation, the association between a particular scum concentration and the nominal/actual difference is generally stored in a data memory in the drum washing machine.

If scum is detected during the spinning, spinning is aborted and the method according to the invention is executed.

In addition to steps a) to f), in the method according to the invention further scum combating measures can be taken. For example, in the rinse cycle a pressure level can be released which prevents scum (a scum mat) from being forced out from the dispenser tray (flushing-in of the detergent). In this situation, releasing a pressure level means that a particular pressure value is given for the sensor, whereby water is fed into the tub until said value is reached. This method is preferred when scum is present. If no scum is present, a particular predefined quantity of water is generally fed in.

A further measure for combating scum consists in reducing the duty cycle ED.

As a further measure for suppressing scum, whilst executing the method according to the invention it is possible to automatically add a substance in order to inhibit the scum.

This is expedient particularly when facilities for the automatic addition of detergents in a drum washing machine are in any case present.

BRIEF DESCRIPTION OF THE DRAWINGS

An embodiment of the invention will be described in detail in the following with reference to FIGS. 1 to 3.

DETAILED DESCRIPTION OF EXEMPLARY EMBODIMENTS OF THE PRESENT INVENTION

Figure 1:
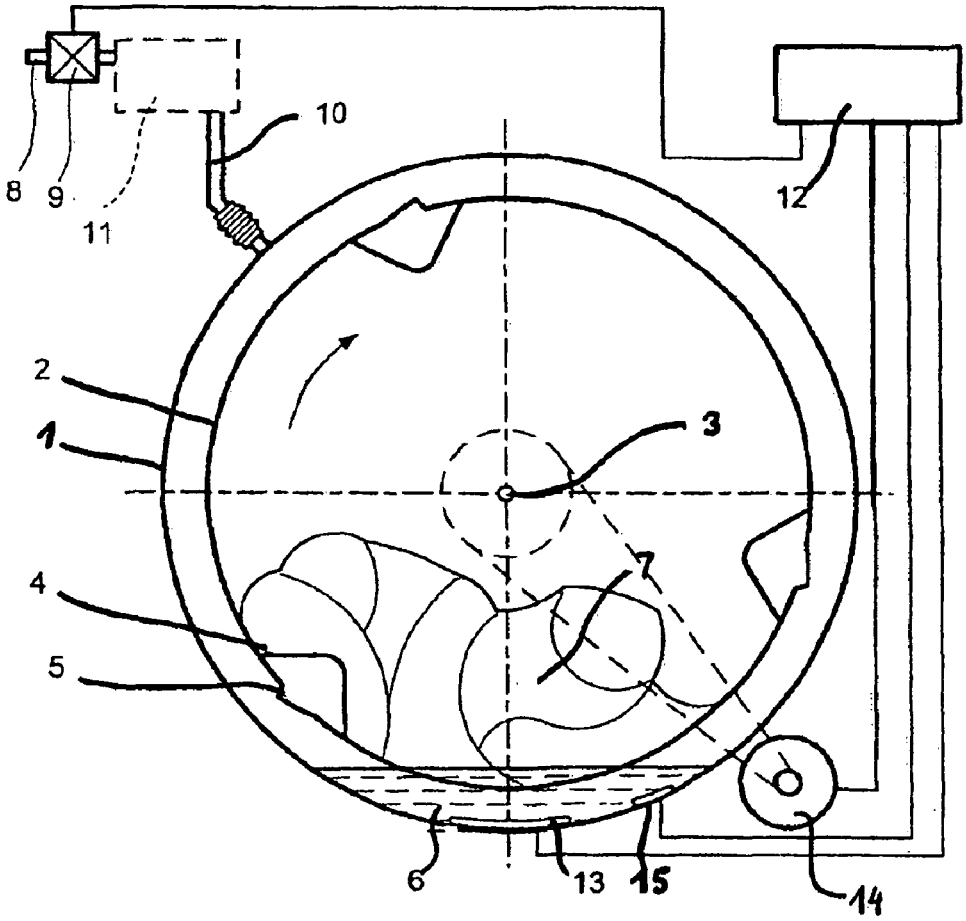
FIG. 1 shows a schematic representation of the relevant parts present of a drum washing machine in which a method for removing scum can be executed.

FIG. 1 shows a schematic representation of the relevant parts present of an embodiment of a drum washing machine in which the method to be described in the following for removing scum can be executed. Other embodiments are conceivable. The drum washing machine in the embodiment shown in FIG. 1 has a tub 1, in which a drum 2 is rotatably mounted and can be driven by the drive motor 14. According to more recent knowledge concerning the ergonomics involved in using such drum washing machines, the axis of rotation 3 of the drum 2 is tilted upwards from the horizontal by a small angle (13° for example) towards the front, such that the user of the drum washing machine has easier access to, and a better view into, the interior of the drum 2. As a result of this arrangement in conjunction with specially formed washing paddles 4 and scooping facilities 5 for the washing detergent solution 6 on the inner surface of the drum body an increase in the penetration of the washing 7 with washing detergent solution and a reduction in the so-called free liquor, which denotes that quantity of washing detergent solution in the tub 1 which can no longer be taken up by the saturated washing (essentially beneath the lowest point of the washing drum 2), are moreover also achieved.

The drum washing machine additionally has a detergent-solution inlet system which comprises a water connection fitting for the domestic water supply 8, an electrically controllable valve 9 and a feed pipe 10 to the tub 1, which where appropriate can also be routed by way of a detergent dispensing facility ("dispenser tray") 11, from which the inlet water can transport portions of detergent into the tub 1. Furthermore, a heating facility 13 is situated in the tub 1. The valve 9 and also the heating facility 13 can be controlled by means of a control facility ("program control unit") 12 depending on a program flowchart which can be linked to a time program and/or to the attainment of certain measured values for parameters such as detergent-solution level, detergent-solution temperature, rotational speed of the washing drum etc. inside the drum washing machine. 15 denotes a sensor for measuring the pressure in the tub 1.

Figure 2:
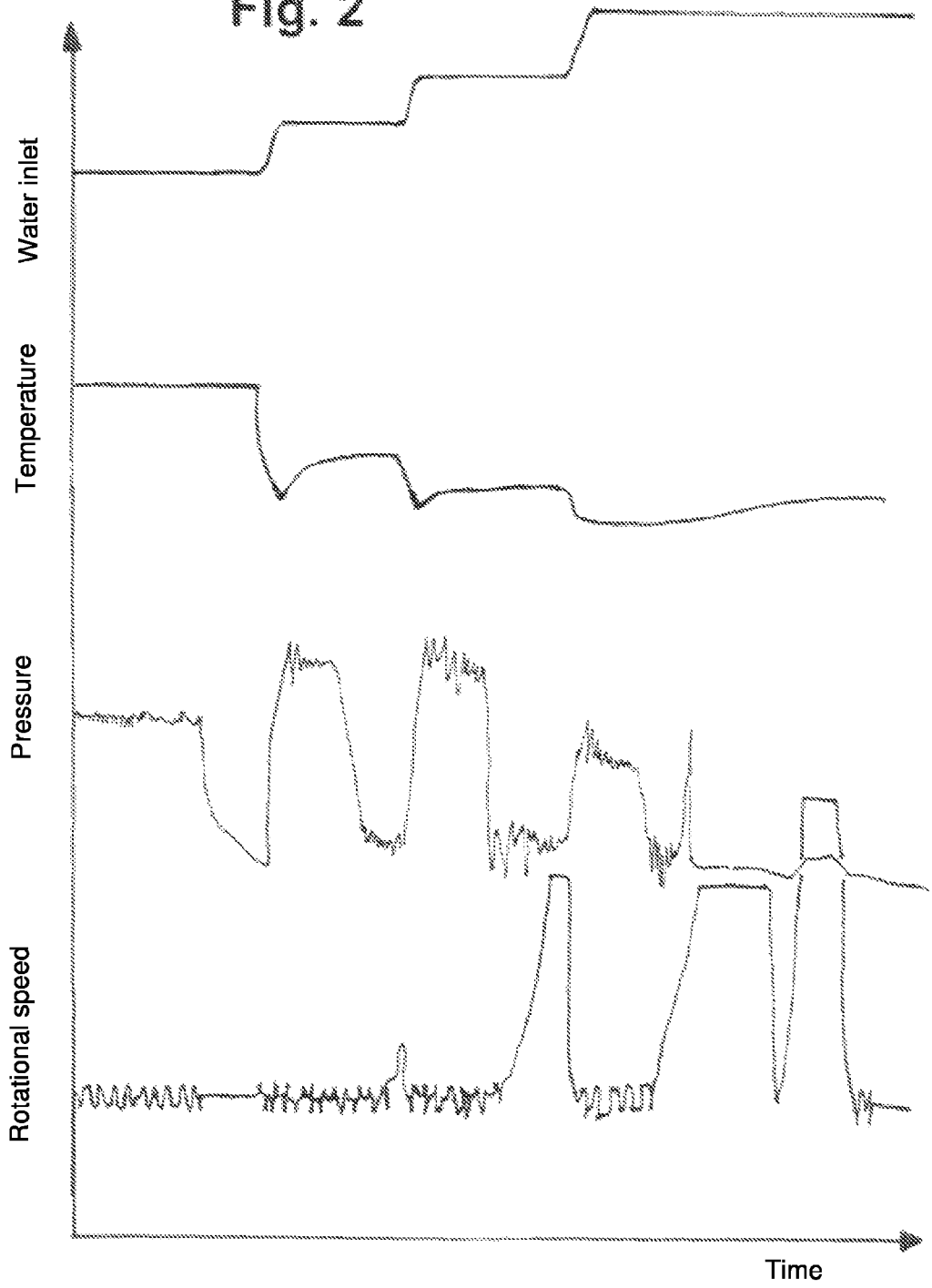
Fig. 2 PRIOR ART
FIG. 2 shows a graphical representation of a typical section from the timing characteristics for rotational speed, water inlet, pressure and temperature during a washing operation for the situation where scum is detected in the case of a conventional method.

FIG. 2 shows a graphical representation of a typical section from the timing characteristics for rotational speed, water inlet, pressure and temperature for the situation where scum is detected in the case of a previously known method. When the washing detergent solution is being pumped out, the pressure measured at the sensor 15 drops, which results in scum detection. As the timing characteristic for the rotational speed of the drum shows, the first spin and rinse does not take place. The first rinse cycle is carried out with a reduced duty cycle ED. In the first spinning operation performed scum is detected again, whereupon the spinning is aborted. The rinse cycle is carried out again with a reduced duty cycle ED. During the third spinning operation no scum is detected, with the result that the duty cycle ED in the following rinse cycle is high again.

Figure 3:
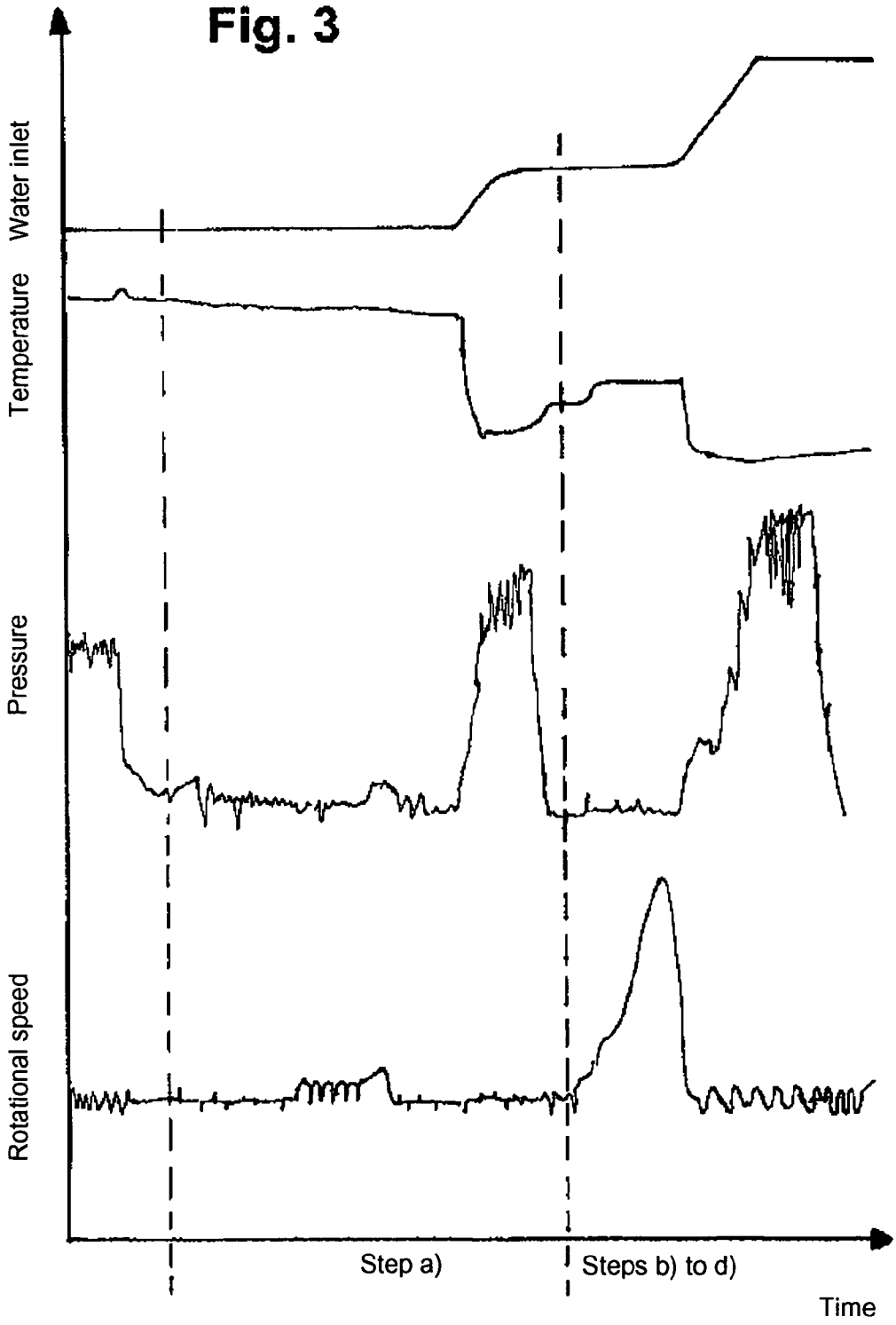
FIG. 3 shows a graphical representation of a section from the timing characteristics for rotational speed, water inlet, pressure and temperature during a washing operation in the event of scum occurring in the case of an embodiment of the method.

FIG. 3 shows a graphical representation of a section from the timing characteristics for rotational speed, water inlet, pressure and temperature in the event of scum occurring in the case of an embodiment of the method described here. Compared with FIG. 2, the timing characteristics for rotational speed, water inlet, pressure and temperature are clearly different.

The invention has numerous advantages. The method according to the invention is characterized by a high level of effectiveness in the case of scum which occurs during the washing operation and can result in overfoaming in the first rinse and spin. In this situation, spinning only takes place when the scum has been sufficiently reduced and the danger of scum exiting from the dispenser tray no longer exists.

In contrast to conventional methods, a mere dilution of the scum is not necessary. With this conventional method, there was a danger of the scum foaming up on account of the constant motion and the entry of water into the scum. The scum was not destabilized but continuously augmented with water. In this manner, visible scum could remain in the drum across a plurality of rinse cycles—in part right up to the last rinse cycle—while the rinse and spin operations were aborted. The rinsing effect was very poor for this situation. The method according to the invention avoids this.

With the method according to the invention on the other hand the small bubbles are already destroyed before water is added. Furthermore, no new scum is whipped up, but instead the detergent concentration is reduced. The rinse and spin operation can be carried out, as a result of which the solution containing detergent is effectively removed and the rinsing effect is improved.

The invention claimed is:

1. A method for removing scum in a tub of an electronically controlled drum washing machine, the method comprising:

alternately rotating a drum following a main washing cycle and pumping liquid out of the drum;

pumping a liquid out of the drum for between 30 seconds to 15 minutes following the main washing cycle and pumping liquid out of the drum;

regulating a level of water following the main washing cycle and pumping liquid out of the drum by:

introducing a quantity of water into the drum which is sufficient to cover all water channels based on a pressure hysteresis measured by a pressure sensor used to determine a level of liquid in the tub such that a scum dilution results without renewed scum formation; and rinsing over a short period of time t2, wherein the short period of time t2 includes a range of 1 minute to 5 minutes; and pumping liquid out of the drum while the drum is moved at a low rotational speed following the main washing cycle and pumping liquid out of the drum, wherein the low rotational speed includes a range of 20 to 60 revolutions per minute, wherein the electronically controlled drum washing machine includes a detergent-solution runoff system arranged on the base of the tub which has a detergent-solution pump and the pressure sensor for determining the level of liquid contained in the tub, the signal from this pressure sensor being recorded during operation of the detergent-solution pump, and the drum.

2. The method of claim 1, wherein the pumping the liquid out of the drum following the main washing cycle and pumping liquid out of the drum includes:

pumping the liquid out of the drum for between 2 minutes to 10 minutes following the main washing cycle and pumping liquid out of the drum.

3. The method of claim 1, wherein the pumping the liquid out of the drum following the main washing cycle and pumping liquid out of the drum includes:

pumping the liquid out of the drum for between 2.5 minutes to 4 minutes following the main washing cycle and pumping liquid out of the drum.

4. The method of claim 1, wherein the low rotational speed includes a range of 30 to 50 revolutions per minute.

5. The method of claim 1, wherein the alternately rotating the drum includes alternately rotating the drum in opposite directions following the main washing cycle and pumping liquid out of the drum.

6. The method of claim 1, wherein the short period of time t2 includes a range of 1 minute to 3 minutes.

7. The method of claim 1, wherein the pressure sensor measures a pressure at an upper switching point for the water supply and a pressure at a lower switching point for the water supply and a pressure difference between the pressure at the upper switching point and the pressure at the lower switching point includes a range of 10 to 150 Pa.

8. The method of claim 1, wherein the pressure sensor measures a pressure at an upper switching point for the water supply and a pressure at a lower switching point for the water supply and a pressure difference between the pressure at the upper switching point and the pressure at the lower switching point includes a range of 20 to 100 Pa.

9. The method of claim 1, wherein the pressure sensor measures a pressure at an upper switching point for the water supply and a pressure at a lower switching point for the water supply and a pressure difference between the pressure at the upper switching point and the pressure at the lower switching point includes a range of 30 to 70 Pa.

10. The method of claim 1, further comprising spinning the drum at a rotational speed below 500 revolutions/minute over a short period of time t3 wherein the short period of time t3 includes a range of 30 seconds to 5 minutes, after alternately rotating the drum and pumping a liquid out of the drum for between 30 seconds to 15 minutes and before regulating the level of water.

11. The method of claim 10, further comprising:

alternately rotating the drum at the low rotational speed after spinning the drum at the rotational speed below 500 revolutions/minute over the short period of time t3;

holding the drum still after spinning the drum at the rotational speed below 500 revolutions/minute over the short period of time t3; and pumping the liquid out between 30 seconds and 15 minutes after the spinning the drum at the rotational speed below 500 revolutions/minute over the short period of time t3.

12. The method of claim 10, wherein the spinning the drum includes:

spinning the drum at a rotational speed below 400 revolutions/minute.

13. The method of claim 10, wherein the spinning the drum includes:

spinning the drum at a rotational speed in a range of 100 to 200 revolutions/minute.

14. The method of claim 1, further comprising performing a normal spin and rinse in which scum can be detected after the pumping liquid out of the drum while the drum is moved at the low rotational speed.

15. The method of claim 14, further comprising:

detecting a scum;

aborting a spinning in response to the detecting the scum; and in response to the detecting the scum, re-executing:

the alternately rotating the drum;

the pumping the liquid out of the drum for between 30 seconds to 15;

the regulating the level of water by introducing the quantity of water into the drum which is sufficient to cover all the water channels and rinsing over the short period of time t2; and the pumping the liquid out of the drum while the drum is moved at the low rotational speed.

16. A drum washing machine comprising:

a controller that controls a program execution;

a drum rotatably mounted in a tub;

a detergent-solution runoff system on a base of the tub, the detergent-solution runoff system including a detergent-solution pump;

a drive motor for the drum;

a heater;

a pressure sensor that determines a level of liquid contained in the tub based on a pressure hysteresis, a signal from the pressure sensor being recorded during operation of the detergent-solution pump; and a switch responsive to a scum being detected, wherein the controller is programmed to control the switch to:

alternately rotate the drum following a main washing cycle and pumping liquid out of the drum;

pump a liquid out of the drum for between 30 seconds to 15 minutes following the main washing cycle and pumping liquid out of the drum;

regulate a level of water following the main washing cycle and pumping liquid out of the drum by:

introducing a quantity of water into the drum which is sufficient to cover all water channels based on the pressure hysteresis measured by a pressure sensor used to determine a level of liquid in the tub such that a scum dilution results without renewed scum formation; and rinse over a short period of time t2, wherein the short period of time t2 includes a range of 1 minute to 5 minutes; and pump liquid out of the drum while the drum is moved at a low rotational speed following the main washing cycle and pumping liquid out of the drum.

* * * * *